United States Patent [19]

Hadfield et al.

[11] 4,128,395

[45] Dec. 5, 1978

[54] TRANSFER PRINTING WITH CARBOXYLIC DYES

[75] Inventors: Harry R. Hadfield; Harry H. Sumner; Gerald Williams, all of Manchester, England

[73] Assignee: Imperial Chemical Industries Limited, London, England

[21] Appl. No.: 423,402

[22] Filed: Dec. 10, 1973

[30] Foreign Application Priority Data

Dec. 15, 1972 [GB] United Kingdom ..... 57969/72

[51] Int. Cl.[2] ..... D06P 5/00

[52] U.S. Cl. ..... 8/2.5 A; 8/2.5 R; 106/22; 428/195; 428/913

[58] Field of Search ..... 8/39 A, 2.5 A, 2.5 R

[56] References Cited

U.S. PATENT DOCUMENTS

| | | | |
|---|---|---|---|
| 3,632,291 | 1/1972 | Defago et al. | 8/2.5 |
| 3,768,280 | 10/1973 | Kannegiesser et al. | 68/5 D |
| 3,813,218 | 5/1974 | De Plasse | 8/2.5 |

FOREIGN PATENT DOCUMENTS

| | | | |
|---|---|---|---|
| 1087673 | 10/1967 | United Kingdom | 8/2.5 UX |

*Primary Examiner*—Stanford M. Levin

*Attorney, Agent, or Firm*—Cushman, Darby & Cushman

[57] ABSTRACT

A process for the transfer color printing of synthetic textile materials which comprises placing a transfer material which carries a colored pattern derived from one or more disperse dyestuffs each containing at least one carboxylic acid group in contact with a synthetic textile material and heating the transfer material and the synthetic textile material while in contact so as to transfer the dyestuff from the transfer material to the synthetic textile material.

2 Claims, No Drawings

TRANSFER PRINTING WITH CARBOXYLIC DYES

This invention relates to a process for colouring synthetic textile materials and more particularly to a process for the transfer colour printing of synthetic textile materials in particular synthetic polyamide textile materials.

In the known process of transfer colour printing, a transfer material which has been printed with an ink or inks containing one or more sublimable disperse dyestuffs is placed in contact with a synthetic textile material and the whole in then heated preferably at a temperature in the region of 160° C. to 220° C. whereby the dyestuff or dyestuffs are transferred from the transfer material to the synthetic textile material. In order that the dyestuffs used in this process transfer satisfactorily in a reasonable time which is usually within the range of 15 to 60 seconds, it is necessary that the dyestuffs sublime easily and for this purpose it is usual to use water-insoluble dyestuffs of the class which are commonly referred to as Disperse Dyestuffs which are free from acidic water-solubilising groups such as carboxylic acid and sulphonic acid groups.

Whilst the known process of transfer colour printing gives colourations on aromatic polyester textile materials which have adequate fastness properties for most end uses, the colourations obtained on synthetic polyamide textile materials have very poor wet fastness properties so that the resulting coloured textile materials have only very limited end uses. Accordingly, in view of this serious deficiency in fastness properties the process of transfer colour printing has made little headway in its application to synthetic polyamide textile materials. It has now been found that the use of Disperse Dyestuffs containing carboxylic acid groups in the process of transfer colour printing gives colourations on synthetic polyamide textile materials which have very much higher fastness to wet treatments than the colourations obtained from the corresponding dyestuffs which are free from carboxylic acid groups.

According to the present invention there is provided a process for the transfer colour printing of synthetic textile materials which comprises placing a transfer material which carries a coloured pattern derived from one or more disperse dyestuffs each containing at least one carboxylic acid group in contact with a synthetic textile material and heating the transfer material and the synthetic textile material whilst in contact so as to transfer the dyestuff from the transfer material to the synthetic textile material.

In this Specification all references to placing the transfer material in contact with the textile material means that it is the printed surface of the transfer material which is placed in contact with the textile material.

The heating is carried out at a temperature above 100° C., preferably at a temperature in the region of 160° C. to 220° C.; whilst higher temperatures can in fact be used, and their use would in fact facilitate transfer of the dyestuff, such temperatures are generally detrimental to the textile material resulting in damage to the fibres and/or discolouration thereof. The time during which the heating is carried out is preferably in the range of from 15 seconds to 1 minute, the time and temperature being so adjusted as to obtain maximum transfer of the dyestuff.

The process can be carried out either batchwise or in a continuous manner, using intermittent presses and continuous calendars such as are conventionally employed in the process of transfer colour printing. Suitable continuous calendars are those manufactured by inter alia the firms of Harrico-Stibbe, Hunt and Mosscrop, Lemaire and Kannegeisser.

It has, however, been found that the introduction of the carboxylic acid group into the disperse dyestuffs lowers the volatility of the dyestuffs so that the amount of dyestuff which is transferred in the present process is generally lower than that transferred in the known process under identical processing conditions, thus resulting in the production of weaker prints. This disadvantage can be overcome by carrying out the present process at a reduced pressure, the heating of the transfer material and the synthetic textile material whilst they are in contact being effected in a zone, the pressure of which is less that atmospheric, and has preferably been reduced to a pressure of less than 100 mms. of mercury. This use of reduced pressure for carrying out the process of the present invention forms a preferred feature of the present invention.

Apparatus, both batchwise and continuous, in which the present process can be carried out at reduced pressure is described in U.S. application Ser. No. 174,906 and No. 334,688, both abandoned.

As examples of synthetic textile materials which can be used in the process of the invention there may be mentioned cellulose acetate in particular cellulose triacetate textile materials, polyacrylonitrile textile materials, polyurethane textile materials, aromatic polyester textile materials and preferably synthetic polyamide textile materials such as those usually designated by the names of Nylon 6, Nylon 6:6 and Quiana (a registered trade mark).

Such textile materials can be in the form of webs or woven or knitted goods which can be either in continuous lengths or in the form of made-up garments, such as dresses, or the individual pieces use in the construction of such garments. The term synthetic textile materials also includes goods, such as carpets and other floor coverings, or flocked materials having a pile or tufts or a flock surface consisting of synthetic fibres. The process is also applicable to the colouration of films of synthetic materials or to materials such as plywood and asbestos board which have been coated or which carry a layer of a synthetic resin having an affinity for disperse dyestuffs.

If desired the synthetic textile materials can be used in the form of unions with other textile materials such an unions of synthetic textile materials with wool or cotton textile materials, but when using such unions in the process it is preferred that the amount of non-synthetic fibres present are less than 30% by weight of the total weight of the textile material.

As previously indicated, the present process is particularly valuable for the colouration of synthetic polyamide textile materials as the resulting colourations obtained have much better fastness to wet treatments. However, a further marked improvement in wet fastness can be achieved if the synthetic polyamide textile material has previously been treated or is after treated with a dye fixing or a tanning agent. The process of transfer colour printing has the advantage that it eliminates the use of all the water employed in aqueous colouring process, so that the necessity to apply the said agent in a separate aqueous treatment may seem to be a retrograde step. However, the synthetic polyamide textile materials have to be given an aqueous scouring process, followed by drying, before they are coloured by transfer printing, and the application of the said agent can be conveniently carried out in conjunction with this scouring process so that an additional treatment is unnecessary unless for some particular reason it is decided to apply the agent as an after-treatment.

If desired, the printed textile materials may be subsequently steamed at normal or elevated pressures to give enhanced penetration of dyestuff into the textile materials.

The said dye fixing or tanning agents can be any of such agents which are conventionally employed with synthetic polyamide textile materials, and can be either natural or synthetic in origin.

Examples of natural agents including tannic acid and the vegetable tannins, whilst synthetic agents include condensation products of napthols, naphthalene sulphonic acids and formaldehyde, condensation products of phenol, naphthalene, formaldehyde and sulphuric acid, condensation products of dihydroxydiphenylsulphones and bisulphites, condensation products of naphthalene sulphonic acids, dihydroxydiphenylsulphone and formaldehyde, condensation products of dihydroxydiphenylsulphone sulphonic acids and aliphatic aldehydes, condensation products of sulphurised phenols, naphthalene and formaldehyde, and condensation products of dicyandiamide, phenols, formaldehyde and ammonium chloride.

The transfer materials used in the process of the invention can be obtained by printing a suitable carrier material, which is preferably paper, with one or more inks containing a disperse dyestuff carrying a carboxylic acid group. The said inks can be applied to the carrier material by any of the known methods for applying printing inks, for example gravure, lithographic, flexographic or screen printing methods, using conventional types of printing machinery for this purpose.

The said inks comprise as the essential ingredients thereof one or more disperse dyestuffs containing a carboxylic acid group, a binder or resin and a liquid medium. The liquid medium can either be water in which case the dyestuff is present in the form of a finely divided dispersion, or can be an organic liquid, or mixtures thereof, in which case the dyestuff is all in solution (depending on the amount of dyestuff present and its solubility in the particular medium) or partly in solution and partly in the form of a finely divided dispersion.

The said inks can be obtained by mixing together the required ingredients, the mixing preferably incorporating a milling or grinding stage in order to ensure that the dyestuff is in finely divided form.

As examples of organic liquids which can be used to prepare the inks there may be mentioned hydrocarbons such as toluene, xylene, and aliphatic petroleum fractions which boil in the range of from 80° to 40° C., alcohols such as ethanol and isopropanol, esters such as ethylacetate, and ketones such as methylethyl ketone.

The binders or resins present in the said inks can also act as dispersing agents for the said dyestuffs, but, if desired, additional dispersing agents can be included in the inks. The binders or resins can be of the binders or resins which are conventionally employed in the manufacture of printing inks, and which are described, for example, in the first adition of the Printing Ink Manual which was published in 1961, and in Ink Technology for Printers and Students by E. A. Apps which was published in 1963. In the case of inks based on organic liquids as the media particularly suitable binders are cellulose ethers which are soluble in such liquids such as ethylcellulose and hydroxypropylcellulose.

The said dyestuffs can be any of the recognised classes of Disperse Dyestuffs which additionally contain one or more carboxylic acid groups, in particular disperse dyestuffs of the nitro, azo, anthraquinone, or quinophthalone series which additionally contain one or more carboxylic acid groups. Many such dyestuffs are in fact known and can be manufactured in conventional manner from the requisite dyestuff intermediates at least one of which contains a carboxylic acid group. As specific examples of such dyestuffs which can be used to obtain the transfer materials used in the process of the present invention there may be mentioned the dyestuffs of the following classes:

(a) The azo dyestuffs of the formula:

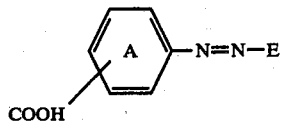

wherein E is the residue of a coupling component of the phenol, naphthol, barbituric acid, acylacetarylamide or 5-pyrazolone series, and the benzene ring A can contain additional substituents such as nitro, chlorine, methyl, methoxy, carboxy or sulphonamido.

(b) The azo dyestuffs of the formula:

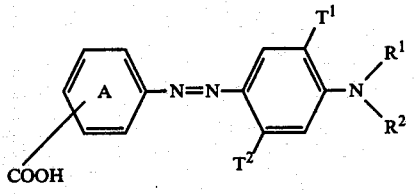

wherein $T^1$ is hydrogen, alkyl, alkoxy, chlorine or bromine, $T^2$ is hydrogen, alkyl, alkoxy, chlorine, bromine or acylamino, $R^1$ is hydrogen or an optionally substituted alkyl radical, $R^2$ is hydrogen or an optionally substituted alkyl, cycloalkyl, phenol or heterocylcic radical, and the benzene ring A can contain additional substituents.

(c) The azo dyestuffs of the formula:

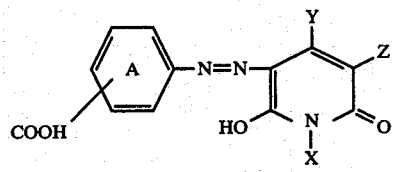

wherein X is hydrogen or an optionally substituted alkyl, cycloalkyl or phenyl radical or an optionally substituted amino group, Z is hydrogen, alkyl, cyano, carboalkoxy or carbonamido, Y is hydrogen, alkyl or phenyl, and the benzene ring A can contain additional substituents.

(d) The azo dyestuffs of the formula:

$$D - N = N - E^1$$

wherein D is the radical of a diazo component of the aromatic or heterocyclic series and $E^1$ is the radical of a coupling component which contains a carboxylic acid group in particular a coupling component of the phenol, naphthol, pyrazolone, acylacetarylamide, 2:6-dihydroxypyridine or 6-hydroxypyrid-2-one series which contains a carboxylic acid group.

(e) The azo dyestuffs of the formula:

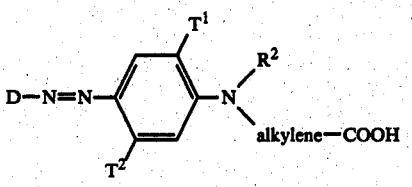

wherein D, $R^2$, $T^1$ and $T^2$ have the meanings stated above.

(f) The anthraquinone dyestuffs of the formula:

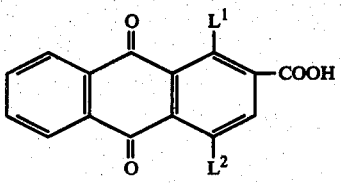

wherein $L^1$ and $L^2$ are each independently hydroxy, amino, alkylamino or arylamino.

(g) The anthraquinone dyestuffs of the formula:

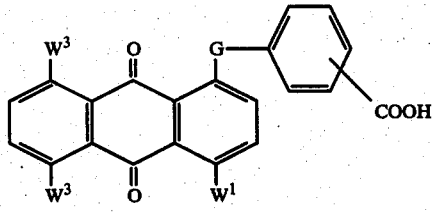

wherein G is —O—, —S—, —NH— or —CONH—, and $W^1$, $W^2$ and $W^3$ are each independently hydrogen, hydroxy, amino, alkylamino or nitro, provided that not all of $W^1$, $W^2$ and $W^2$ are hydrogen and that not more than one of $W^1$, $W^2$ and $W^3$ is nitro.

(h) The quinophthalone dyestuff of the formula:

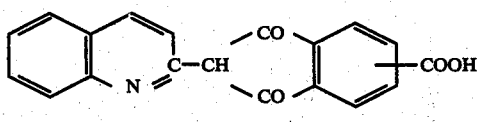

and the quinoline nucleus can be additionally substituted by hydroxy, chlorine, bromine, nitro, alkyl or alkoxy.

(i) The nitro dyestuffs of the formula:

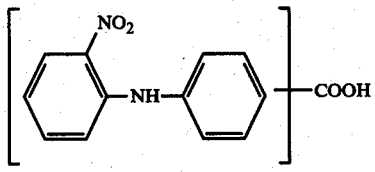

and the benzene rings can contain additional substituents such as nitro, chlorine, bromine, hydroxy sulphanamido, methyl and methoxy.

The printed synthetic textile materials obtained by the process of the invention can be produced in a wide variety of shades having very good fastness to the tests which are commonly applied to the various textile materials, in particular to light, to wet treatments and to dry heat treatments. As previously stated the process is particularly suitable for obtaining prints on synthetic polyamide textile materials which have very good fastness to wet treatments, and in this respect the prints are markedly superior to those produced from the corresponding dyestuffs which do not contain carboxylic acid groups.

The invention is illustrated but not limited by the following Examples in which the parts and percentages are by weight.

EXAMPLE 1

A transfer paper is prepared by printing a paper with an ink comprising a finely divided dispersion of 2.6 parts of 4-(2'-cyano-4'-nitrophenylazo)-N-ethyl-N-(β-carboxyethyl)aniline in a mixture of 3 parts of a modified locust bean gum, 1 part of tartaric acid and 93.4 parts of water and the paper is then dried.

A piece of the resulting transfer paper is then placed in contact with a woven polyethyleneterephthalate textile material (the printed surface of the paper being in contact with the textile material) in an intermittent vacuum press, such as is described in our Belgian Pat. No. 774,855, and which is then operated for 60 seconds at 220° C. with an applied vacuum of 27 inches (685 mms.) of mercury. The textile material is printed in a deep maroon shade having good fastness to light, to wet treatments and to dry heat treatments.

Secondary cellulose acetate, cellulose triacetate or polyacrylonitrile textile materials can be similarly printed using this transfer paper by operating the press for 60 seconds at 200° C. with an applied vacuum of 685 mms. of mercury.

EXAMPLE 2

100 Parts of a woven polyhexamethyleneadipamide (Nylon 6:6) textile material are treated for 30 minutes in a solution of 2 parts of a naphthalene sulphonic acid/dihydroxydiphenylsulphone/formaldehyde condensate and 3 parts of formic acid in 1,000 parts of water at 95° C. The textile material is then removed from the bath, rinsed in water and dried.

A piece of the transfer paper obtained as described in Example 1 is placed in contact with a piece of the treated Nylon 6:6 textile material in an intermittent vacuum press and the press then operated for 60 seconds at 220° C. with an applied vacuum of 685 mms. of mercury. The textile material is printed in a deep maroon shade having very good fastness to wet treatments, and in this respect is superior to the wet fastness of a print which was similarly obtained on the Nylon 6:6 textile material which had not been given a pre-treatment in the above solution.

EXAMPLE 3

A transfer paper is prepared by printing a paper with an ink comprising a finely divided dispersion of 0.8 part of 2-methyl-4'-nitro-4-[N-ethyl-N-(γ-carboxythio-β-hydroxypropyl)amino]azobenzene in a solution of 0.01 part of the sodium salt of a naphthalene sulphonic acid/formaldehyde condensate, 1 part of tartaric acid and 3 parts of a modified locust bean flour in 94.2 parts of water, and then drying the paper.

The resulting paper is placed in contact with a piece of the pre-treated Nylon 6:6 textile material obtained as described in Example 2 in an intermittent vacuum press, and the press then operated for 60 seconds at 220° C. with an applied vacuum of 700 mms. of mercury. A red print of excellent fastness to washing is obtained.

EXAMPLE 4

A transfer paper is prepared by printing a paper with an ink comprising a finely divided dispersion of 1 part of 1-phenyl-3-methyl-4-(o-carboxyphenylazo)-5-pyrazolone in a solution of 5 parts of a low viscosity ethyl hydroxyethyl cellulose in a mixture of 5 parts of isopropanol and 90 parts of an aliphatic petroleum fraction boiling at 100°–120° C., and the printed paper is then dried.

A woven Nylon 6 textile material is padded through a solution of 30 parts of a sulphurised phenol/formaldehyde condensate and 20 parts of formic acid in 1,000 parts of water, and the textile material is passed through a padding mangle so that it retains 80% of its own weight of the said solution, and the textile material is then dried.

A piece of the transfer paper described in this Example is placed in contact with a piece of the treated Nylon 6 textile material, and transfer then carried out for 60 seconds at 220° C. in an intermittent vacuum press using an applied vacuum of 680 mms. of mercury.

A bright yellow print is obtained and the fastness to wet treatments is higher than that of a print which was obtained in similar manner using the Nylon 6 textile material which had not been pre-treated.

EXAMPLE 5

Transfer prints are obtained by placing the transfer paper obtained as described in Example 4 in contact with either a woven aromatic polyester textile material or with a woven polyacrylonitrile textile material in an intermittent vacuum press which is then operated for 60 seconds at 200° C. with an applied vacuum of 700 mms. of mercury. Bright yellow prints are obtained.

EXAMPLE 6

A transfer paper is prepared by printing a paper with an ink comprising a finely divided dispersion of 1.3 parts of 1-hydroxy-4-(o-carboxyanilino)anthraquinone in a solution of 3 parts of a modified locust bean flour in 95.7 parts of water, and the paper is then dried.

A piece of the transfer paper is placed in contact with a nylon pile carpet in an intermittent vacuum press which is then operated for 60 seconds at 220° C. with an applied vacuum of 685 mms. of mercury. The carpet is printed in a blue shade of excellent fastness to shampooing.

EXAMPLE 7

A transfer material is prepared by applying to aluminium foil an ink comprising a dispersion of 0.75 part of 1-amino-4-anilinoanthraquinone-2-carboxylic acid in a mixture of a 7.5 parts of low viscosity ethyl hydroxyethyl cellulose, 15 parts of a resin ester of pentaerythritol, 5.5 parts of isopropanol and 72 parts of an aliphatic of petroleum fraction, boiling at 100°–120° C., and the material is then dried.

100 Parts of a woven Nylon 6:6 textile material is padded through a 3% aqueous solution of a dicyandiamide/phenol/formaldehyde/ammonium chloride condensate, passed through a padding mangle so that it retains 90 parts of the said solution, and then dried.

A piece of the transfer material is placed in contact with a piece of the treated Nylon 6:6 textile material in an intermittent vacuum press which is then operated for 60 seconds at 220° C. with an applied vacuum of 685 mms. of mercury. A blue print of good fastness to washing is obtained.

EXAMPLE 8

Transfer prints are obtained by placing the transfer material obtained as described in Example 7 in contact with either an aromatic polyester textile material or with a cellulose triacetate textile material in an intermittent press which is then operated for 60 seconds at 220° C. with an applied vacuum of 685 mms. of mercury. Blue prints are obtained.

EXAMPLE 9

A transfer paper is obtained by printing a paper with an ink comprising a mixture of 2 parts of 4-(2'-cyano-4'-nitrophenylazo)-N-methyl-(β-carboxyethyl)aniline, 5 parts of a high viscosity ethyl hydroxyethyl cellulose, 5 parts of isopropanol and 88 parts of an aliphatic petroleum fraction boiling at 100°–120° C., and then the paper is then dried.

A piece of the transfer paper is placed in contact with a piece of a polyurethane fabric in an intermittent press which is then operated for 60 seconds at 180° C. with an applied vacuum of 685 mms. of mercury. A reddish-violet print is obtained.

Reddish violet prints are obtained by applying the above transfer paper to aromatic polyester, secondary cellulose acetate, polyacrylonitrile or cellulose triacetate textile materials using 60 seconds at 200° C. with an applied vacuum of 685 mms. of mercury.

We claim:

1. A process for the transfer colour printing of synthetic polyamide textile materials, which comprises placing a transfer material which carries a coloured pattern derived from one or more disperse dyestuffs each of which contains one carboxylic acid group in contact with the synthetic textile material and heating the transfer material and the synthetic textile material in a zone which is maintained at a pressure less than atmospheric pressure whilst they are in contact so as to transfer the dyestuff from the transfer material to the synthetic textile material.

2. A process as claimed in claim 1 wherein the synthetic polyamide textile material is given a treatment with a dye fixing or a tanning agent before or after the heating stage in contact with the transfer material.

* * * * *